US005131901A

United States Patent [19]

Moll

[11] Patent Number: 5,131,901

[45] Date of Patent: Jul. 21, 1992

[54] SCORING AND PERFORATING APPARATUS

[76] Inventor: Richard J. Moll, c/o Dick Moll and Sons, Warminster, Pa. 18974

[21] Appl. No.: 723,574

[22] Filed: Jul. 1, 1991

[51] Int. Cl.[5] ..... B65H 45/28; B65H 35/02; B31F 1/10

[52] U.S. Cl. ..... 493/355; 493/365; 493/367; 493/370; 493/403; 83/450; 83/678

[58] Field of Search ..... 493/354, 355, 365, 367, 493/369, 370, 403; 83/332, 422, 430, 435.2, 450, 678

[56] References Cited

U.S. PATENT DOCUMENTS

| | | | |
|---|---|---|---|
| 3,157,398 | 11/1964 | Zahradnik | 493/403 |
| 3,757,970 | 9/1973 | Pfaffle | 83/29 |
| 3,837,265 | 9/1974 | Tokuno | 493/365 |
| 3,855,890 | 12/1974 | Lynch et al. | 83/678 |
| 4,166,613 | 9/1979 | Kort et al. | 493/365 |
| 4,562,687 | 1/1986 | Green | 493/142 |
| 4,597,751 | 7/1986 | Rank | 493/403 |
| 5,057,068 | 10/1991 | Capdeboscq | 493/367 |

*Primary Examiner*—William E. Terrell
*Attorney, Agent, or Firm*—Zachary T. Wobensmith, III

[57] ABSTRACT

Apparatus for scoring and perforating sheets of paper which receives sheets of paper in flat or folded condition and which applies scoring or perforating lines at selected locations, and delivers the sheets to a folding machine or other apparatus for further processing.

5 Claims, 6 Drawing Sheets

SCORING AND PERFORATING APPARATUS

BACKGROUND OF THE INVENTION

1. Field of the Invention

This invention relates to apparatus for inline application of scoring and perforating lines to sheets of paper, which are thereafter delivered to a folding or other machine for further processing.

2. Description of the Prior Art

In making folded paper documents and particularly those of heavy stock, it is necessary to apply scoring lines at the locations where the documents are to be folded prior to folding. It has heretofore been proposed to apply the scoring lines in the folding machine itself, but the results are not always satisfactory as many folding machines do not have that capability. In addition, portions of the apparatus must often be removed prior to scoring and/or perforating the stock, which increases the cost of processing the documents.

The application of suitable scoring lines to permit folding of heavy stock can also be done in a die or letter press, but the extra operations and handling may result in prohibitive cost.

It is also often necessary to apply lines of perforation to paper stock prior to folding, so that a portion of the finished folded document can be detached at a later time. Accordingly, it is desirable to have an apparatus that can be used with existing folding machines, that rolls up to the machine, can be easily set up for scoring and/or perforating operations and delivers the scored and/or perforated product in-line to a folding or other machine for further operations as required, and which can be used off line as a stand above perforating or scoring apparatus.

SUMMARY OF THE INVENTION

Scoring and perforating apparatus is provided that is portable, and can be used in-line in combination with folding or other paper processing machines, which applies scoring and/or perforation lines to sheets of paper and delivers the finished sheets for further processing.

The principal object of the invention is to provide self contained scoring and perforating apparatus.

A further object of the invention is to provide apparatus of the character aforesaid, which is versatile and can be used with virtually any existing folding machine.

A further object of the invention is to provide apparatus of the character aforesaid, which is portable and can be precisely located and stabilized prior to operation.

A further object of the invention is to provide apparatus of the character aforesaid that can be quickly and easily set up for scoring and/or perforating and which provides high quality results.

A further object of the invention is to provide apparatus of the character aforesaid which performs the scoring and perforating operations inline and straight through the apparatus.

A further object of the invention is to provide apparatus of the character aforesaid which can be used with sheets of paper that are in flat or in folded condition.

Other objects and advantageous features of the invention will be apparent from the description and claims.

DESCRIPTION OF THE DRAWINGS

The nature and characteristic features of the invention will be more readily understood from the following description taken in connection with the accompanying drawings forming part hereof, in which.

Figure 1:
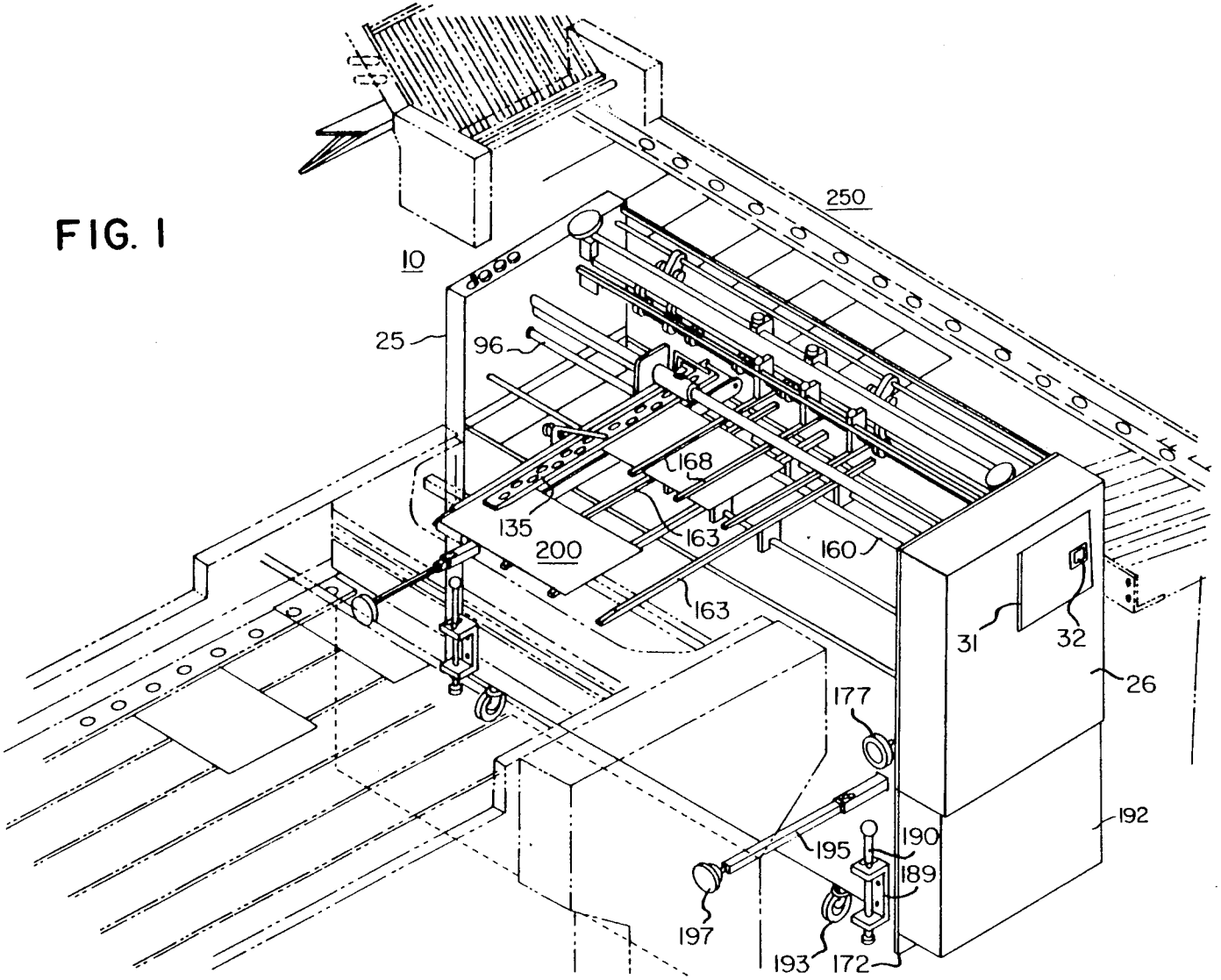
FIG. 1 is a view in perspective of the apparatus of the invention, in place, in combination with at least one folding machine, which is shown in phantom.
Figure 2:
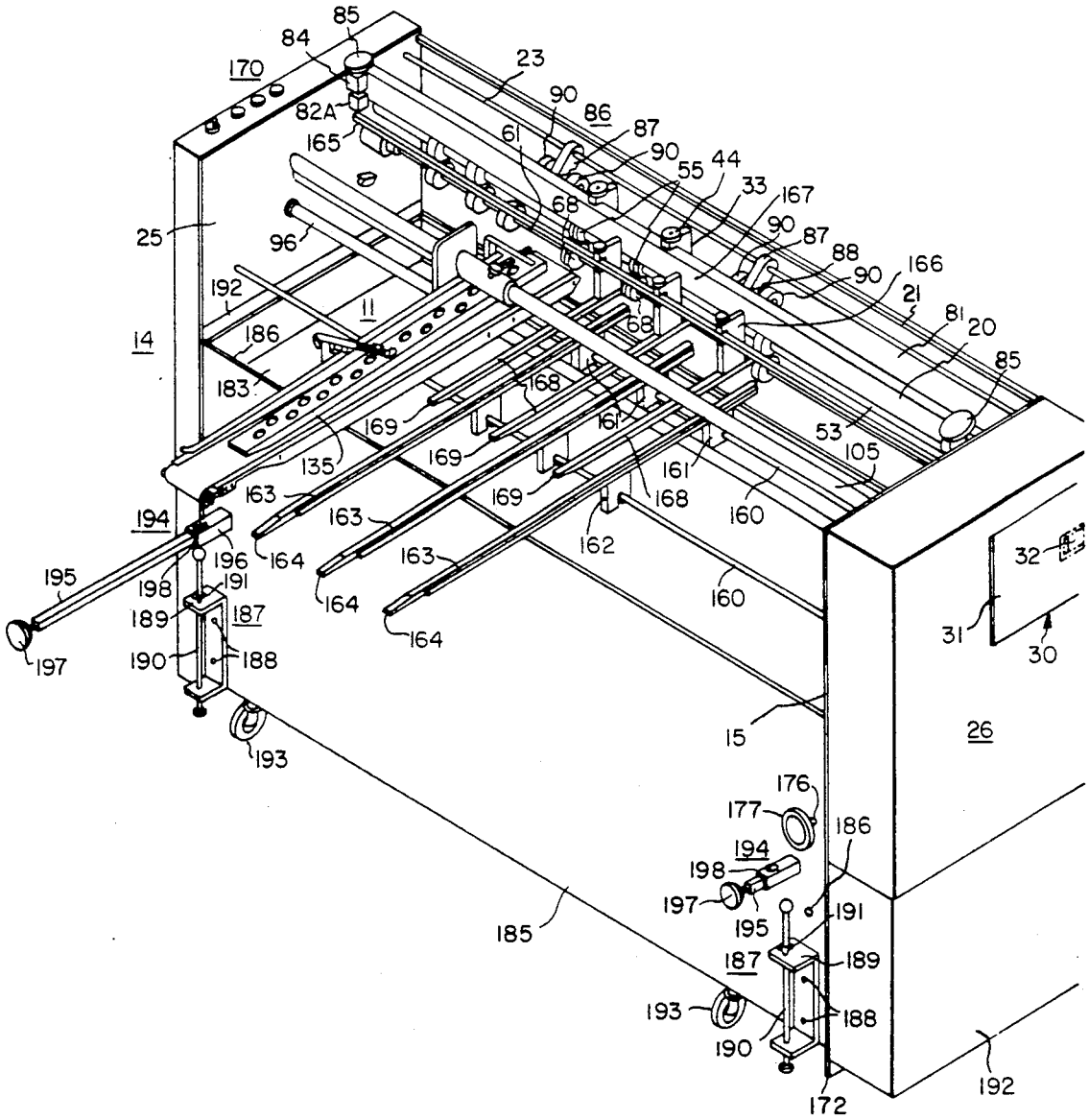
FIG. 2 is a view in perspective of the apparatus of the invention illustrated in FIG. 1, but enlarged to illustrate greater detail.

It should, of course, be understood that the description and drawings herein are merely illustrative and that various modifications and changes can be made in the structure disclosed without departing from the spirit of the invention.

Like numerals refer to like parts throughout the several views.

DESCRIPTION OF THE PREFERRED EMBODIMENTS

Referring now more particularly to the drawings and FIGS. 1 to 5, inclusive, the scoring and perforating apparatus 10 of the invention is therein illustrated. The apparatus 10 includes a frame 11 with a right side 12 and a left side 14. The side 12 includes an upper plate 15, preferably of steel, and of rectangular configuration, with two vertical channels 16 secured thereto by bolts 17 and which are connected at the bottom by a lower horizontal member (not shown). The plate 15 has cross-members 19, 20 and 21 connected to it by bolts 17 and which are also connected to an upper plate 25 of left side 14, by any suitable means such as by bolts (not shown). The plate 25 has channels 29 similar to channels 16, connected to it and to a lower member (not shown) as described for plate 15.

The right side plate 15 has a cover 26 secured thereto by any well known means, such as by bolts (not shown) and which cover extends downwardly over the plate 15. The cover 26 has an opening 30, with a panel 31 hingedly secured to the cover, closing off the opening 30 and which includes a latch 32 engaged with cover 26 and panel 31.

Figure 4:
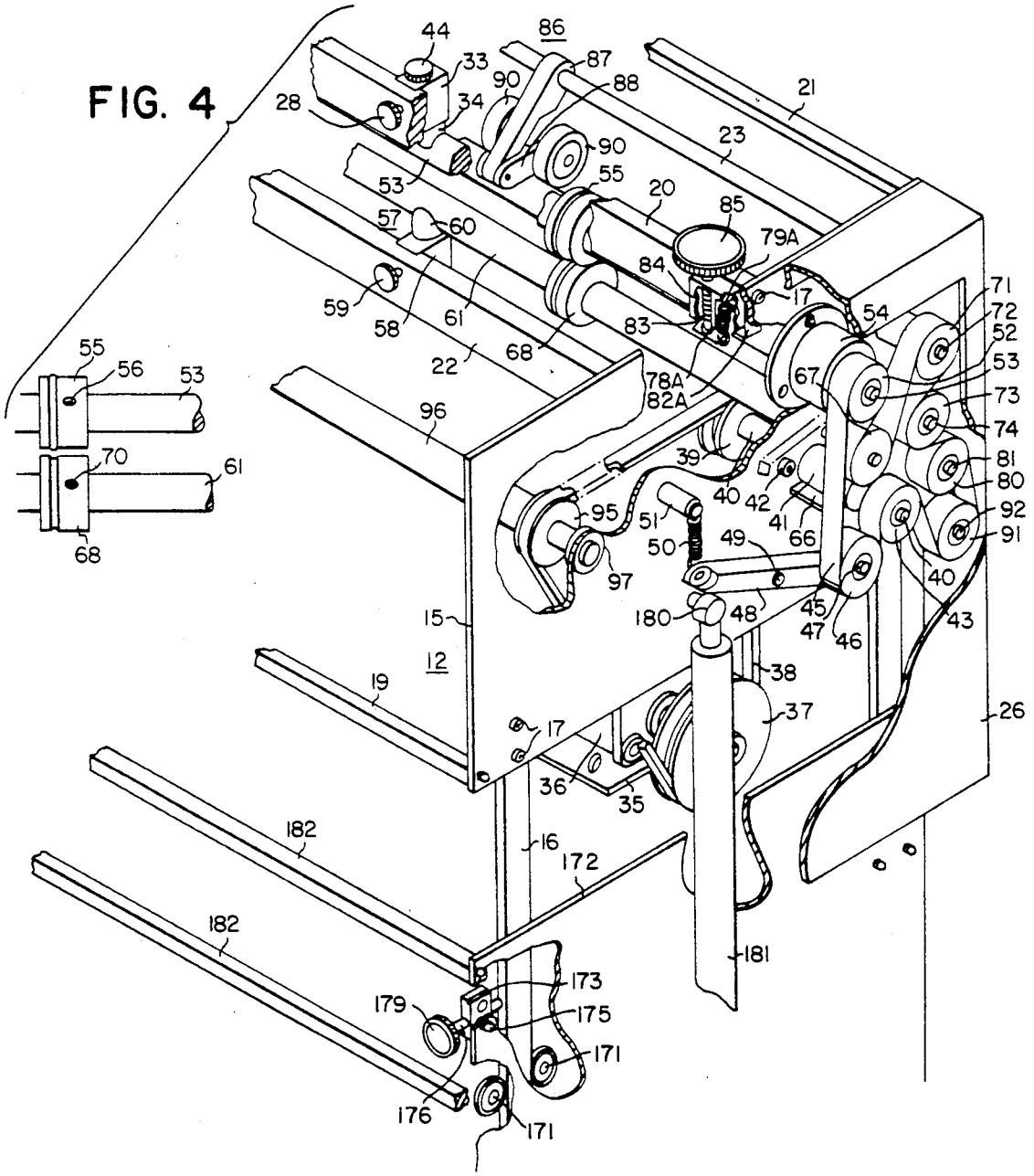
FIG. 4 is a view similar to FIG. 3 illustrating another portion of the apparatus.

The plate 15 has a motor mounting plate 35 connected thereto, which carries an electric motor 36 thereon of well known type. The motor 36 has an output pulley 37 of the V type connected thereto, and with an endless V belt 38 engaged therewith. The belt 38 is engaged with a V-pulley 39 on shaft 40 which is journaled in bearing 41 secured to the plate 15 by bolts 42. The shaft 40 has a hub 43 mounted thereon, which is preferably of steel and with an endless flat belt 45 engaged therewith. The belt 45 at the left as shown in FIG. 4 is engaged with a hub 46 on shaft 47 carried on arm 48, which is pivotally mounted by shaft 49 to plate 15, with spring 50 connected thereto and to stud 51 in plate 15 to place and maintain tension on belt 45. The belt 45 is engaged with a hub 52 mounted to an upper scoring shaft 53, which is journaled in eccentric bearing assembly 54 mounted to plate 15 by screws 17, and which shaft extends across to left side plate 25 where it is journaled in an eccentric bearing assembly 75 mounted to plate 25 by screws (not shown). The eccentric bearing assemblies 54 and 75 are similar and each includes an eccentric hub 76 mounted in a collar 77 which is moved around by levers 78 and 78A which are connected to the eccentrics 76 and extend to springs 79 and 79A mounted on blocks 82 and 82A fastened to plates 15 and 25 by screws 17. Spring 79 is under compression and spring 79A is under tension.

The levers 78 and 78A are engaged by threaded rods 83 mounted in blocks 84 and 84A fastened to plates 15 and 25 by screws (not shown).

The rods 83 have hand wheels 85 thereon for rotation of the rods in blocks 84 and 84A to move levers 78 and 78A to cause eccentrics 76 to rotate and shaft 53 to move scoring collars 55 closer or away from collars 68 as required.

The shaft 53 is provided with a plurality of male scoring collars 55 retained thereto by screws 56, with two sets of male scoring collars 55 being illustrated, but which could be perforating collars if desired. The crossmember 20 is located above scoring shaft 53. The crossmember 20 is provided with two stabilizers 27 each of which includes a block 33 connected to crossmember 20 by bolt 28, and a rod 34 engaged with screw 44 in block 33 for vertical adjustment of rod 34, which is engaged with and puts downward pressure on upper scoring shaft 53. A lower scoring shaft 61 is provided, which is journaled in bearing 65 mounted to plate 66, which is fastened to plate 15 by screws 17, thereon with hub 67 thereon engaged by belt 45. The lower scoring shaft 61 extends transversely across the apparatus and is journaled in a bearing (not shown) mounted to plate 25 by screws (not shown).

The lower scoring shaft 61 has a plurality of female collars 68, two sets being shown and retained on shaft 61 by screws 70. The collars 68 are illustrated as female scoring collars, but could be perforating collars if desired, and are located on shaft 61 opposite to and in line with the male scoring collars 55.

A crossmember 22 is provided below shaft 61 with two stabilizers 57 thereon, which each include a block 58 connected thereto by bolt 59, and a rod 60 engaged with a screw (not shown) in block 58 for vertical adjustment of rod 60 which is engaged with and puts upward pressure on lower scoring shaft 61.

The belt 45 extends from hub 67 to an idler hub 71 on stub shaft 72, secured to plate 15, and then onto hub 73 on upper ejection shaft 74, which is journaled in a bearing (not shown) carried on plate 15. The shaft 74 extends transversely across the apparatus and is journaled in a bearing (not shown) in plate 25.

The shaft 74 has a plurality of wheels (not shown) mounted thereon which are preferably of rubber with a smooth exterior surface which contact the sheets of paper stock (not shown). The belt 45 next extends to a hub 80 carried on a lower ejection shaft 81, below shaft 74, which is journaled in a bearing (not shown) on plate 15. The shaft 81 extends transversely across the apparatus and is journaled in a bearing (not shown) on plate 25. The shaft 81 has a plurality of wheels (not shown) thereon similar to wheels (not shown) on shaft 74 and located in opposed position thereto. The wheels (not shown) grip sheets of paper (not shown) between them after scoring or perforating operations have been performed, as described below, and eject them from the apparatus 10. A crossmember 23 is provided between plates 15 and 25 which has a plurality of ejection roller assemblies 86 thereon, which include arms 87 engaged with the crossmember 23. The arms 87 each have an arm 88 pivotedly engaged therewith, and rotatably carrying a pair of rollers 90. The rollers 90 are of smooth rubber and engage the sheets of treated paper (not shown) to be described.

The belt 45 from hub 80 extends around another idler hub 91 on stub shaft 92 which is mounted to plate 15. The belt 45 then extends to hub 43 and therearound as described above.

Figure 3:
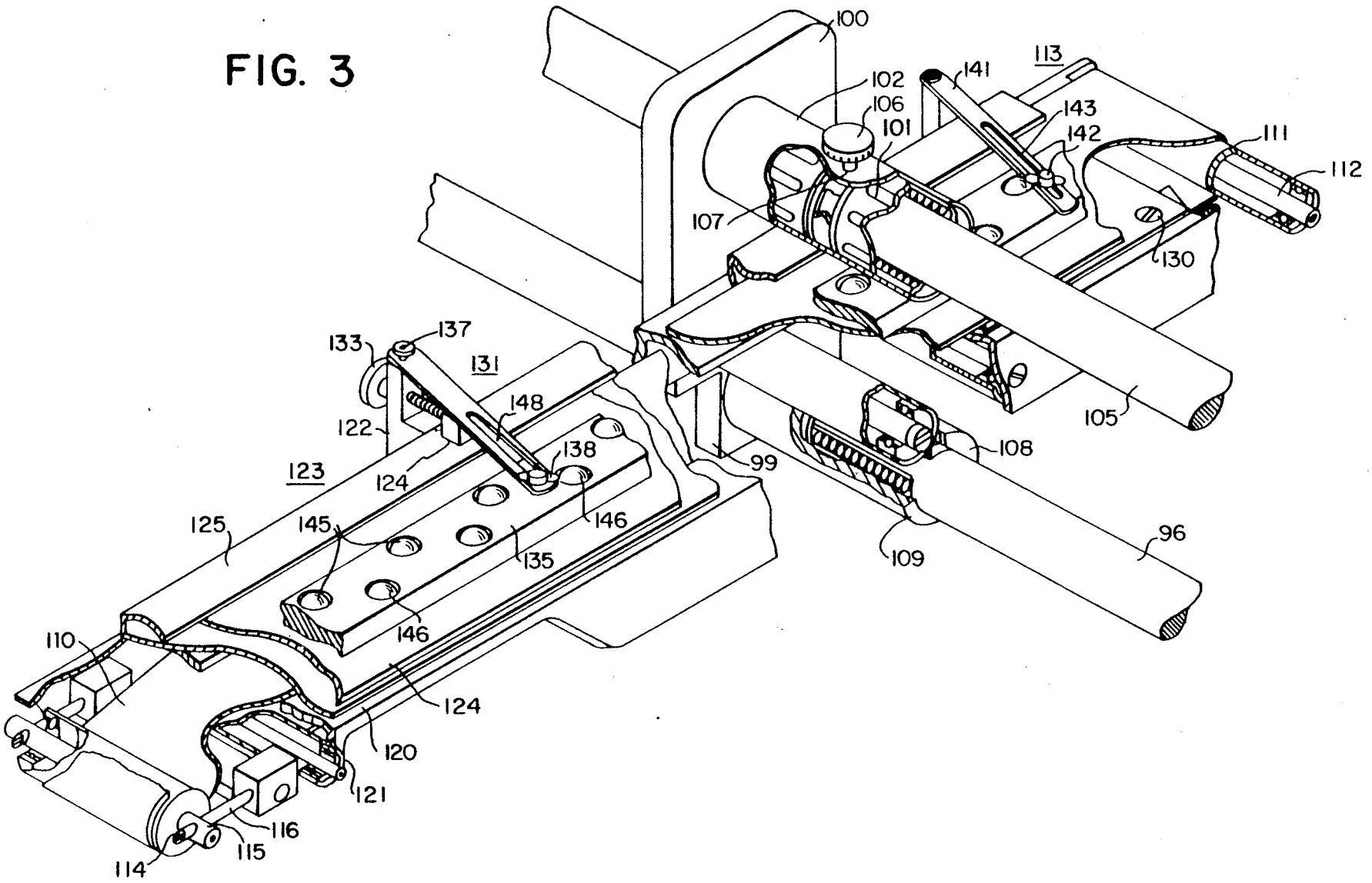
FIG. 3 is a perspective view, enlarged, and partially broken away of a portion of the apparatus of FIG. 2.

The belt 38 from V-pulley 39 is also engaged with a V-pulley 95 fastened to shaft 96, which is journaled in bearing 97, mounted in plate 15, and extends transversely across the apparatus to a bearing (not shown) in plate 25. The shaft 96 is also engaged in bearing (not shown) in a vertical plate 100 as shown in FIG. 3. The plate 100 has a bearing 101 therein, carried in a linear housing 102, of well known type which bearing 101 is carried on and movable along a transfer shaft 105, which extends between and is mounted to plates 15 and 25.

The housing 102 has an adjustment knob 106 and shaft 107, which engages shaft 105 to lock plate 100 at selected locations.

The shaft 96 has a roller 108 thereon, which has a smooth outer surface 109 to grip and drive an endless register belt 110. The belt 110 is also carried on ar ear idler roller 111 on shaft 112 of a carriage frame 113, which is fastened to plate 100. The carriage 113 includes a front idler roller 114 carried on shaft 115, which is engaged with threaded rods 116 which connect it to the carriage frame 113, and which rods 116 can be rotated to move the roller 114 against belt 110 to vary the tension on the belt 110 as required. The carriage frame 113 includes a bed 120 which carries an additional idler roller 121 which also engages belt 110, which belt extends under bed 120 to rear idler roller 111. The belt 110 extends over a paper stock side guide 123, which is carried on top of bed 120 and extends therealong, with a center plate 124 and an L-shaped side guide plate 125, which extends along guide 123 for guiding the paper sheets. The guide 123 is pivotedly attached to the bed 120 by a screw 130 at the rear thereof, and moves across the plate 124 by a side guide adjusting assembly 131. The assembly 131 includes an L-shaped block 132 fastened to carriage frame 113, with an adjustment screw 133 engaged therewith and with a block 134 carried on plate 125 to move guide plate 123. A marble guide plate 135 is provided on top of belt 110 and engaged by a front adjusting arm 136, which is attached to block 132 by screw 137, and to guide plate 135 by a turn screw 138, which is also movable in slot 140 of arm 136 for marble guide plate adjustment. The marble guide plate 135 adjacent the rear of carriage frame 113 has a rear marble guide plate adjusting arm 141 engaged by a turn screw 142, which is carried in the plate 135, and movable in slot 143 of arm 141 for adjustment of plate 135. The marble guide plate 135 is preferably of plastic and has a plurality of openings 145, which carry marbles 146 of conventional well known type which normally rest on belt 110.

A pair of guide shafts 160 are provided which extend transversely across the apparatus 10 and are connected to plates 15 and 25. The shafts 160 have vertical plates 161 thereon, which can move transversely and be locked thereto by screws 162 in plates 161 which engage the shafts 160. The plates 161 have paper guide rods 163 connecting pairs of plates 161, which extend toward the front or entrance of the apparatus as shown in FIG. 3, and have tapered front portions 164. An additional guide shaft 165 is provided adjacent cross-member 20 and which also extends transversely across apparatus 10, connected to plates 15 and 25 with a plurality of vertical plates 166 engaged therewith, three being illustrated and movable transversely, with screws 167 therein to engage shaft 165 and lock plates 166 at selected locations. The plates 166 each have a paper guide rod 168 extending therefrom toward the front of the apparatus and between guide rods 163, with tapered front portions 169.

The apparatus 10 at left side 14 has controls 170 which include on-off, speed, and other controls (not shown) as required for operation of the apparatus.

The upper plate 15 as shown in FIG. 4 has its channels 16 engaged between rollers 171 carried on a lower plate 172 to permit vertical adjustment of plate 15 and also plate 25. The plate 172 has a block 173 secured thereto by bolts 175 with a screw 176 therein with head 177 and for engagement with channel 16. The upper plate 15 ha one end 180 of a hydraulically actuated cylinder 181 which is also attached (not shown) to lower plate 172 to raise and lower plate 15 as required. The plate 172 has crossmembers 182 connected thereto and to another lower plate 183 on side 14. A front cover plate 185 is provided which spans plates 172 and 183 and is connected thereto and to crossmembers 182 by bolts 186. A pair of stabilizer assemblies 187 are provided fastened to plate 185 by bolts 188 and which include U-shaped brackets 189 and vertically extending rods 190 which can be moved vertically against the floor (not shown) and locked by retainers 191 of well known type for stabilization of the apparatus 10.

The plate 185 has a pair of outrigger assemblies 194 extending therefrom, one in extended and one in retracted position. The assemblies 194 each includes a rod 195 carried in a housing 196 mounted to plate 185, with bumpers 197 which can engage adjacent equipment (not shown) as required. The rods 195 are provided with turn screws 198 carried in housings 196 to retain the rods 196 in selected retracted or extended position.

A pair of lower plate covers 192 are provided which extend over the lower plates 172 and 183 and are retained thereto in well known manner (not shown).

A pair of swivel castors 193 are provided attached to lower plates 172 and 183 at the front in well known manner, with an additional pair of swivel castors at the back (not shown) to permit the apparatus 10 to be moved along the floor (not shown) in position for use as required.

Figure 5:
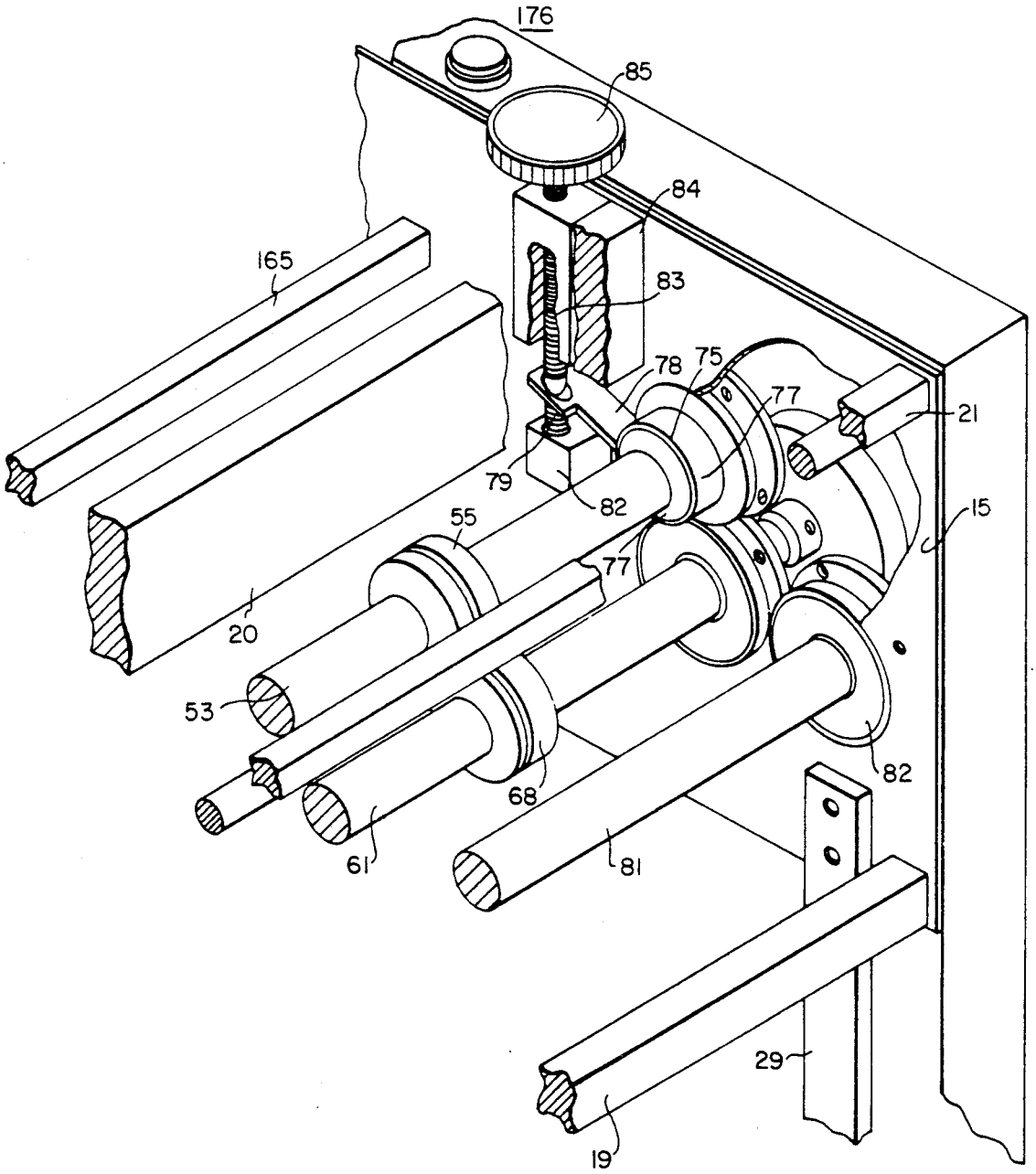
FIG. 5 is a view similar to FIG. 4 illustrating another portion of the apparatus.
Figure 6:
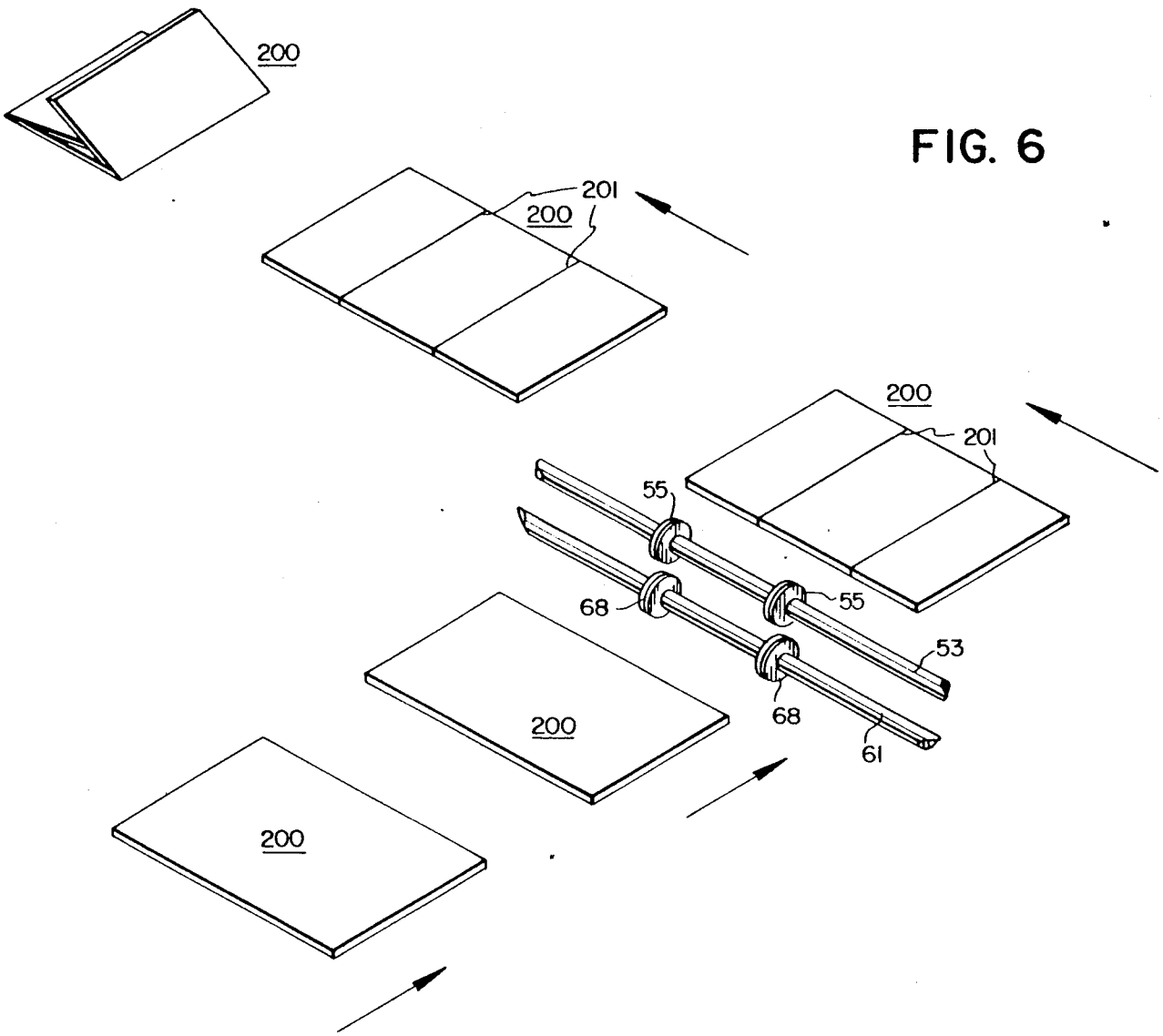
FIG. 6 is a schematic view illustrating folding operations being performed on sheets of paper which have been scored and/or perforated by the apparatus of the invention.

Referring now more particularly to FIG. 5, two sheets of paper 200 are shown in non-scored condition which move between scoring collars 55 and 68, which apply lines of scoring 201 thereon. The scored sheets 200 move through a folding machine (not shown) where the sheets are folded in conventional manner.

The mode of operation will now be pointed out.

When it is desired to apply scoring or perforating lines to sheet stock the appropriate scoring or perforating collars 55 and 68 are installed on shafts 53 and 61 and secured at the desired location.

Motor 36 is actuated and sheets of paper stock 200 are fed into apparatus 10 between guide rods 163 and 168 and are transported by belt 110 under marble guide plate 135, until they move between the scoring collars 55 and 68 where scoring or perforating lines 201 are made in sheets 200. The scored sheets 200 are discharged onto the bed of a folding machine 250 (shown in phantom) where they are folded in conventional manner.

It will thus be seen that apparatus has been provided with which the objects of the invention are achieved.

I claim:

1. Apparatus for inline application of scoring and/or perforating liens to sheets of paper which comprises a bed, an endless driven belt on said bed to receive and transport said sheets of paper, a marble guide plate on said belt and under which said sheets of paper are transported, a side guide plate adjacent said bed to receive and guide edge portions of said sheets of paper on sai belt, paper guide rods situated to receive and guide said sheets of paper at surface portions disposed laterally of said belt, a lower driven rotating shaft, a plurality of collars on said lower shaft, an upper driven rotating shaft, a plurality of collars on said upper shaft in opposed position to said lower shaft collars, said paper sheets being transported by said belt and guided by said paper guide rods to and between said collars, said collars comprising means for applying said lines of scoring or perforation, and a plurality of ejection roller assemblies to receive said sheets of paper from said collars and deliver them for folding or other operations.

2. Apparatus as defined in claim 1 in which said apparatus is provided with vertical height adjustment means.

3. Apparatus as defined in claim 1 in which said apparatus is provided with swivel castors for portability.

4. Apparatus as defined in claim 1 in which said collars on said upper shaft are male collars and said collars on said lower shaft are female collars.

5. Apparatus as defined in claim 1 in which said upper and said lower scoring shafts are provided with adjustable stabilizers engaged with said shafts.

* * * * *